US010982930B2

(12) United States Patent
Lance et al.

(10) Patent No.: US 10,982,930 B2
(45) **Date of Patent: *Apr. 20, 2021**

(54) RAPID ADJUST BUCKLE WITH INTEGRAL FLEXIBLE PULL LOOP

(71) Applicant: Vista Outdoor Operations LLC, Anoka, MN (US)

(72) Inventors: Troy E. Lance, Livingston, MT (US); Robert J. Meinert, Andover, MN (US); Paul N. Smith, Bozeman, MT (US); Clif Hampel, Boise, ID (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/749,189

(22) Filed: Jan. 22, 2020

(65) Prior Publication Data

US 2020/0278175 A1 Sep. 3, 2020

Related U.S. Application Data

(63) Continuation of application No. 16/230,541, filed on Dec. 21, 2018, now Pat. No. 10,545,007, which is a (Continued)

(51) Int. Cl.

| | |
|---|---|
| ***F41C 33/02*** | (2006.01) |
| ***F41C 33/00*** | (2006.01) |
| ***F41C 23/02*** | (2006.01) |

(52) U.S. Cl.

CPC ..... *F41C 33/002* (2013.01); *F41C 23/02* (2013.01)

(58) Field of Classification Search

CPC ..... F41C 33/00; F41C 33/002; F41C 33/006; F41C 23/02; Y10S 224/913; A44B 11/02; A44B 11/04; A44B 11/06; A44B 11/10

See application file for complete search history.

(56) References Cited

U.S. PATENT DOCUMENTS

| | | | |
|---|---|---|---|
| 1,323,701 | A | 12/1919 | Lethern |
| 1,490,066 | A | 4/1924 | Carr |

(Continued)

OTHER PUBLICATIONS

Mirrorless Comparison, "Peak Design Slide vs. Slide Lite vs. Leash—Accessory Comparison" [online] (retrieved from the internet Sep. 25, 2018) <URL http://web.archive.org/web/20170618003435/https://mirrorlesscomparison.com/accessories/peak-design-slide-vs-slide-lite-vs-leash/>, Jun. 18, 2017 (Jun. 18, 2017); entire document.

(Continued)

*Primary Examiner* — Corey N Skurdal

(74) *Attorney, Agent, or Firm* — Reed Smith LLP; Matthew P. Frederick; Cheryl L. Gastineau

(57) ABSTRACT

Embodiments of the disclosure are directed to a rapid adjust buckle for a rifle sling. The buckle can include a main buckle portion with a pair of side portions and a handle portion extending between the pair of side portions and over the main buckle portion to define a handle aperture. In various embodiments the handle portion and the main buckle portion are a unitary piece composed of a polymer material with the handle portion being flexibly biased towards an uncompressed open shape such that the handle portion is configured to compress against the main buckle portion in response to a compressing force but return to the uncompressed open shape when the compressing force is relieved. In one or more embodiments the handle portion includes a plurality of jointed connection points configured to flatten the profile of the handle portion when the handle portion is exposed to the compressing force.

26 Claims, 18 Drawing Sheets

Related U.S. Application Data continuation of application No. 16/041,178, filed on Jul. 20, 2018, now Pat. No. 10,209,031.

(60) Provisional application No. 62/620,212, filed on Jan. 22, 2018, provisional application No. 62/535,213, filed on Jul. 20, 2017.

(56) References Cited

U.S. PATENT DOCUMENTS

| | | | |
|---|---|---|---|
| 2,343,118 | A | 2/1944 | White |
| 3,060,537 | A | 10/1962 | Hatfield |
| 3,081,923 | A | 3/1963 | Bagby |
| 3,948,423 | A | 4/1976 | Hathaway |
| 3,982,769 | A | 9/1976 | Färlind |
| 4,608,735 | A | 9/1986 | Kasai |
| 4,696,505 | A | 9/1987 | Shadoan |
| 4,819,844 | A | 4/1989 | Niemela |
| D328,044 | S | 7/1992 | Murai |
| 5,246,154 | A | 9/1993 | Adams et al. |
| D340,008 | S | 10/1993 | Anscher |
| 5,282,558 | A | 2/1994 | Martinez |
| D347,601 | S | 6/1994 | Anscher |
| D352,254 | S | 11/1994 | Prosser |
| 5,379,726 | A | 1/1995 | Mann |
| 5,433,360 | A | 7/1995 | Rock |
| 5,715,979 | A | 2/1998 | Crandall |
| 5,718,363 | A | 2/1998 | Graves |
| 6,068,167 | A | 5/2000 | Hopson |
| 6,260,748 | B1 | 7/2001 | Lindsey |
| 6,325,258 | B1 | 12/2001 | Verdugo et al. |
| 6,520,390 | B2 | 2/2003 | Verdugo et al. |
| 6,536,153 | B2 | 3/2003 | Lindsey |
| 6,681,973 | B2 | 1/2004 | Crumrine |
| D507,509 | S | 7/2005 | Hou |
| D507,763 | S | 7/2005 | Kaneko et al. |
| 6,932,254 | B2 | 8/2005 | Eliason |
| 7,048,161 | B2 | 5/2006 | George |
| 7,059,502 | B2 | 6/2006 | Johnson |
| 7,069,624 | B2 | 7/2006 | Johnson |
| 7,082,709 | B2 | 8/2006 | Lindsey |
| D579,819 | S | 11/2008 | Brown |
| D586,692 | S | 2/2009 | Nykoluk |
| D619,497 | S | 7/2010 | Paik |
| D619,928 | S | 7/2010 | Bodino et al. |
| D632,954 | S | 2/2011 | Fitzpatrick et al. |
| D636,835 | S | 4/2011 | Fitzpatrick et al. |
| D636,836 | S | 4/2011 | Fitzpatrick et al. |
| 7,959,046 | B2 | 6/2011 | Burnsed, Jr. et al. |
| 7,988,023 | B1 | 8/2011 | Nykoluk |
| D679,580 | S | 4/2013 | Fitzpatrick et al. |
| 8,430,285 | B2 | 4/2013 | Burnsed, Jr. |
| D683,262 | S | 5/2013 | Fitzpatrick et al. |
| 8,516,732 | B2 | 8/2013 | Burnsed, Jr. |
| 8,544,153 | B2 | 10/2013 | Mayberry et al. |
| 8,596,504 | B2 | 12/2013 | Haley, Sr. et al. |
| D700,541 | S | 3/2014 | Iannello et al. |
| D702,311 | S | 4/2014 | Fitzpatrick et al. |
| D703,096 | S | 4/2014 | Kelleghan |
| 8,733,601 | B2 | 5/2014 | Burnsed et al. |
| D710,480 | S | 8/2014 | Fitzpatrick et al. |
| D729,689 | S | 5/2015 | Kelleghan |
| 9,157,699 | B2 | 10/2015 | Ward et al. |
| D745,630 | S | 12/2015 | Eitan et al. |
| D745,631 | S | 12/2015 | Eitan et al. |
| D746,404 | S | 12/2015 | Chow et al. |
| D750,530 | S | 3/2016 | VanHoutin et al. |
| D755,328 | S | 5/2016 | Eitan et al. |
| D755,330 | S | 5/2016 | Etian et al. |
| 9,557,138 | B2 | 1/2017 | Alford |
| D782,364 | S | 3/2017 | Nykoluk |
| D790,779 | S | 6/2017 | Javornick et al. |
| D816,545 | S | 5/2018 | Kelleghan |
| D821,259 | S | 6/2018 | Ciptak et al. |
| D822,537 | S | 7/2018 | Smuin |
| D823,717 | S | 7/2018 | Ho |
| D838,916 | S | 1/2019 | Piombino et al. |
| D840,869 | S | 2/2019 | Koreishi |
| D840,870 | S | 2/2019 | Koreishi |
| D848,899 | S | 5/2019 | Chang |
| 2002/0153393 | A1 | 10/2002 | Verdugo et al. |
| 2003/0034371 | A1 | 2/2003 | Crumrine |
| 2003/0037417 | A1 | 2/2003 | Shen et al. |
| 2004/0188476 | A1 | 9/2004 | Johnson |
| 2007/0278262 | A1 | 12/2007 | Gallagher |
| 2008/0217371 | A1 | 9/2008 | Wemmer |
| 2008/0302838 | A1 | 12/2008 | Burnsed, Jr. |
| 2009/0321484 | A1 | 12/2009 | Schweikert |
| 2011/0186603 | A1 | 8/2011 | Alford |
| 2012/0324686 | A1 | 12/2012 | Ishii |
| 2013/0101280 | A1 | 4/2013 | Xu |
| 2013/0305582 | A1 | 11/2013 | Mayberry et al. |
| 2013/0333168 | A1 | 12/2013 | Burnsed, Jr. |
| 2014/0091115 | A1 | 4/2014 | Haley et al. |
| 2014/0203053 | A1 | 7/2014 | Rivas-Schlanger |
| 2014/0263489 | A1 | 9/2014 | Hendricks |
| 2014/0367427 | A1 | 12/2014 | Bjelde et al. |
| 2015/0272280 | A1 | 10/2015 | Muller |
| 2015/0292834 | A1 | 10/2015 | McCarthy |
| 2016/0123374 | A1 | 5/2016 | Roberts |
| 2016/0128452 | A1 | 5/2016 | Eitan et al. |

OTHER PUBLICATIONS

LK-GVS, YKKfastening.com, [online], [site visited Jul. 22, 2019]. <URL: https://www.ykkfastening.com/products/search/detail.html?Pdid1=LK-GVS> (Year: 2019).

Locwave Adjuster: LK-WGS, Ykkfatening.com [online], [site visited Jul. 22, 2019]. <URL: https://www.ykkfastening.com/products/search/detail.html?pdid1=Locwave+Adjuster(TM)+%ef%bc%9a+LK-WGS> (Year: 2019).

AR-15-Vickers Sling Installation—Blue Force Gear, YouTube.com nsz85, Published on Jul. 31, 2016, [online], [site visited Jul. 22, 2019]. <URL: https://www.youtube.com/watch?v=fNo-xqi3ZJo> (Year: 2016).

RAPID ADJUST BUCKLE WITH INTEGRAL FLEXIBLE PULL LOOP

CROSS-REFERENCE TO RELATED APPLICATIONS

This application is a continuation of U.S. patent application Ser. No. 16/230,541 filed Dec. 21, 2018, which is a continuation application of U.S. patent application Ser. No. 16/041,178, filed Jul. 20, 2018, which claims the benefit of U.S. Provisional Patent Application No. 62/535,213, filed Jul. 20, 2017 and U.S. Provisional Patent Application No. 62/620,212, filed Jan. 22, 2018, the entire contents of which are incorporated by reference herein.

FIELD OF THE DISCLOSURE

The disclosure relates generally to buckles for use with slings for weapons. More specifically, the disclosure relates to rapidly adjustable buckles for use with rifle slings.

BACKGROUND

Existing buckles for use with rifle slings typically are bulky and non-flexible, compromising a user's ability to rapidly adjust the buckle on the sling. Further, such known buckles comprise multiple components that are labor intensive and costly to assemble.

SUMMARY

One or more embodiments of the disclosure are directed to a multipoint rifle sling. In various embodiments the multipoint rifle sling includes a first sling portion, a second sling portion, and a plurality of connectors for connection of the rifle sling to weapon system, such as a rifle. In various embodiments, the second sling portion is configured in a raid adjustment configuration, utilizing a rapid adjust buckle.

In various embodiments the buckle includes a main buckle portion and a handle portion. In certain embodiments the buckle is a unitary piece of material and, in configuration with a strap, is adjustable by a user to quickly establish a desired length of one or more portions of the sling in a single motion. The handle may be formed of a flexible but biased material and in various embodiments is configured to compress into a flattened shape in response to a compressing force but is also biased to return to a normal or uncompressed shape once the compressing force is removed. Similarly, in various embodiments the handle is configured to expand upwardly in response to a pulling force to increase the outward height of the rapid adjust buckle. In various embodiments, the expanded height allows a user to generate a greater moment force on the buckle when moving the buckle using the handle for rapid position adjustment.

In certain embodiments however, the flexibility of handle is limited to vertical dimension of the buckle such that when the handle is manipulated by a user the handle does not flex or bend in a direction parallel with the longitudinal axis of the rifle sling. In such embodiments, the buckle facilitates rapid adjustment by providing a consistent shape and resistance for a user when manipulating the buckle as part of the rifle sling.

In various embodiments the handle extends between lateral sides of the buckle and has an arcuate shape that defines an opening between the handle and buckle that is substantially perpendicular to the length of the strap.

In one or more embodiments the configuration of the handle allows it to be easily grasped with a single hand of the user, even where the user is wearing tactical gloves or other article that impedes the user's hand dexterity. In addition, in certain embodiments the buckle is configured for rapid adjustment of the length of one or more portions of the sling. For example, discussed further below the buckle and/or portions of the sling can be configured to such that friction between different portions of the sling are limited during length adjustment.

In one or more embodiments the buckle includes one or more gripping portions defined by a ridge or frictional area that allows a user to easily grasp onto the buckle even while a user is wearing gloves, in wet conditions, or in other conditions which would traditionally impede manipulation of the buckle 100. In various embodiments, the gripping portions include a portion of raised material that tapers rearwardly from an apex to a rearward edge for placement of a user's thumb or finger for manipulating the position of the buckle.

In various embodiments the multipoint rifle sling is convertible between single-point and two-point configurations, as the rifle sling is intended to work with a large variety of rifles and other weapon platforms. In such embodiments, the combination of the quick adjust configuration of the sling, with the ability to convert between single-point and two-point configurations presents a high level of adaptability to virtually any weapon platform and adaptability to a variety of gear that may be worn by a user. For example, the sling presents adaptability for gear worn at the chest, such as multiple magazines, armor plating and the like, and well as adaptability to different body sizes, from small to double XL.

In certain embodiments the length of the sling can be changed or customized in at least three different methods. Such methods can include, on the fly adjustment, adjustment prior to deployment, and adjustment by way of elasticity. In various embodiments, on the fly adjustment is enabled by the rapid adjust buckle. In certain embodiments prior to deployment adjustment is enabled at least by means of traditional buckles, such as two tri-glide buckles in the center section of the sling. In certain embodiments, elasticity based adjustment is enabled with an elastic portion of the sling, such as a cushioned stretch portion of the sling and/or a flat bungee portion. In such embodiments, the elastic portion of the sling can provide length adjustment in the range of approximately 4".

As such, embodiments of the disclosure provide benefits in the form of a rifle sling that works with many gun types and sizes, unknown mission specifications, different gun handling techniques. With such a design, one tactical sling can substitute for many.

In addition, in various embodiments the rapid-adjust buckle provides unique properties that are beneficial to the end user in a tactical shooting environment, such as with use with a S.W.A.T team making an entry to a building or other mission. In a relaxed state, the buckle holds a biased shape with a multi-faceted perimeter. During use, an operator can insert a finger or thumb inside an opening defined by the handle of the multi-faceted buckle and can push or pull on the buckle, using the handle, to rapidly adjust the sling length. Because the buckle maintains a consistent shape, the opening defined by the handle also maintains a consistent shape. As such, the operator does not have to take their eyes off the target or their sights in order to locate the handle and opening of the rapid adjust buckle for sling length adjustment.

Known rifle slings force users to locate a dangling/swinging pull tab on a slider, or "fit" a thumb inside a fabric loop to adjust the sling length. Because these sling length adjustment points are made of woven fibers, they fatigue over time, and change shape or other physical properties when wet or soiled. Known rifle slings include those discussed in U.S. Pat. Nos. 7,959,046; 8,430,285; 8,596,504; 8,733,601; and 9,557,138. These patents are incorporated by reference herein in their entirety for all purposes.

Conversely, because embodiments of the rapid adjust buckle contain high elasticity properties and specific wall thicknesses, the multi-faceted top half of the slider can deform or deflect under pressure or load, and then rebound fully to it's original biased shape. By always re-forming the same multi-faceted opening for a pull/push point, embodiments of the disclosure provide consistency for the user in weapons manipulation. Such consistency is a critical factor in weapons accessory design, as it allows for a user to maintain their eyes down-range or on-target.

In certain embodiments, an additional benefit of the rapid adjust buckle is its anti-microbial properties. In some embodiments, the rapid adjust buckle is constructed from plastic, or other non-absorbant material, such that the buckle will not absorb blood and potentially expose a user to blood-borne pathogens or bacteria, a health hazard. Furthermore, in various embodiments the rapid adjust buckle is silent in use. Competitive products use metal, hard plastics and strips of woven webbing sewn to the slider as the hand grasping point. When these hard surfaces in close proximity to the gun make contact with a gun, they make noise potentially alerting enemy personnel to a user's position.

In various embodiments the rapid adjust buckle is a unitized injection molded design, with one part containing the multi-faceted pull point, webbing connection point at the rear base, and the webbing tensioning path. By simplifying construction, the part is very lightweight, low cost and strong, with a break strength above 300 lbs.

In various embodiments, when the buckle is viewed from the end, the buckle forms an eight sided geometric closed shape, with the main buckle portion base defining a lower leg of the shape, two parallel legs extending away from the base, a pair of outwardly diverging or flared outward legs extending from the two parallel legs, a pair of converging legs extending from the flared outward legs, and a distal leg bridging ends of the converging legs. In certain embodiments, each leg may be substantially straight. In some embodiments, all legs of the eight sided geometric shape may be substantially straight except the distal leg which may have a slight curvature. A feature and advantage of this shape is that a loop is formed that has an internal width, a width of the opening, that is greater than the width of the base, facilitating finding, grasping, and pulling the buckle with a finger. In embodiments the base and two parallel legs are substantially not deformable and the two diverging legs, two converging legs, and distal leg are deformable as a group when pulled or compressed.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
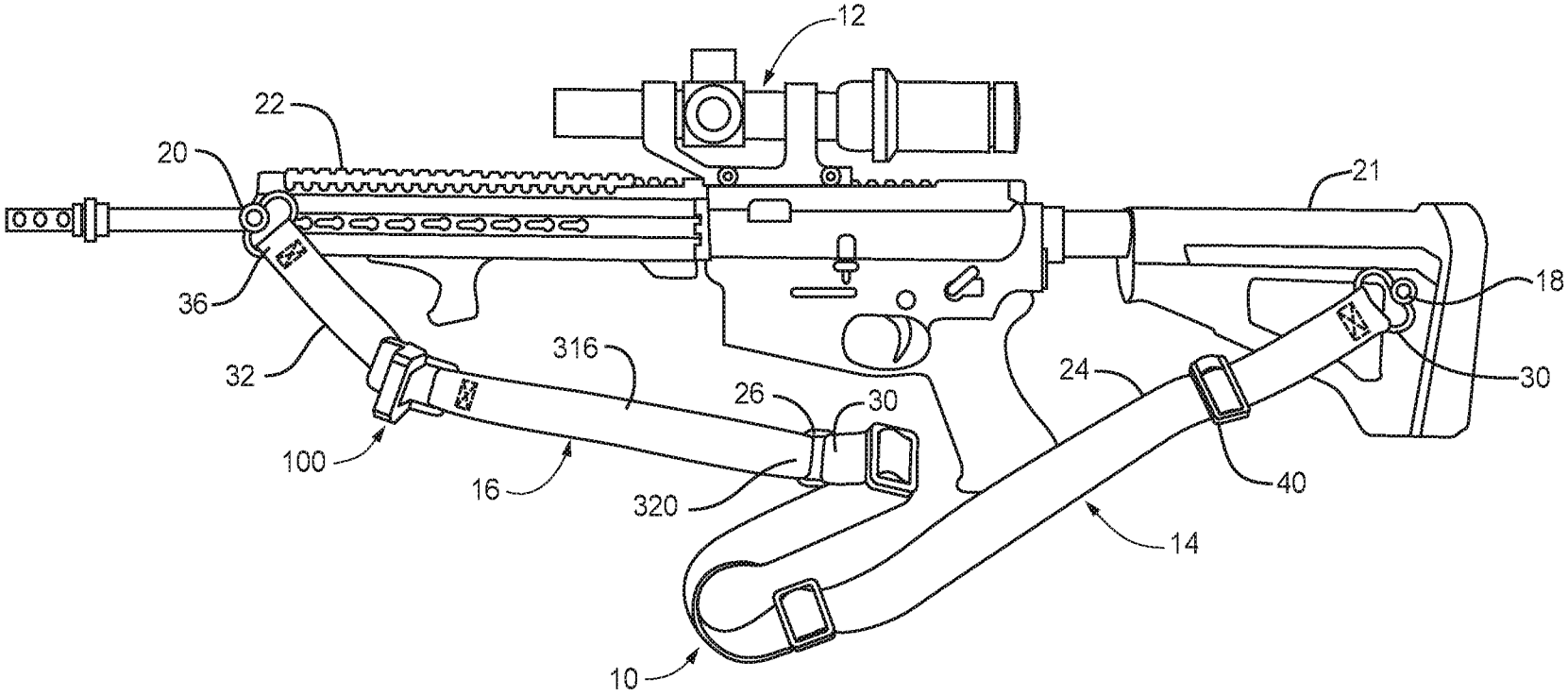
FIG. 1 depicts a multipoint rifle sling and rifle, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
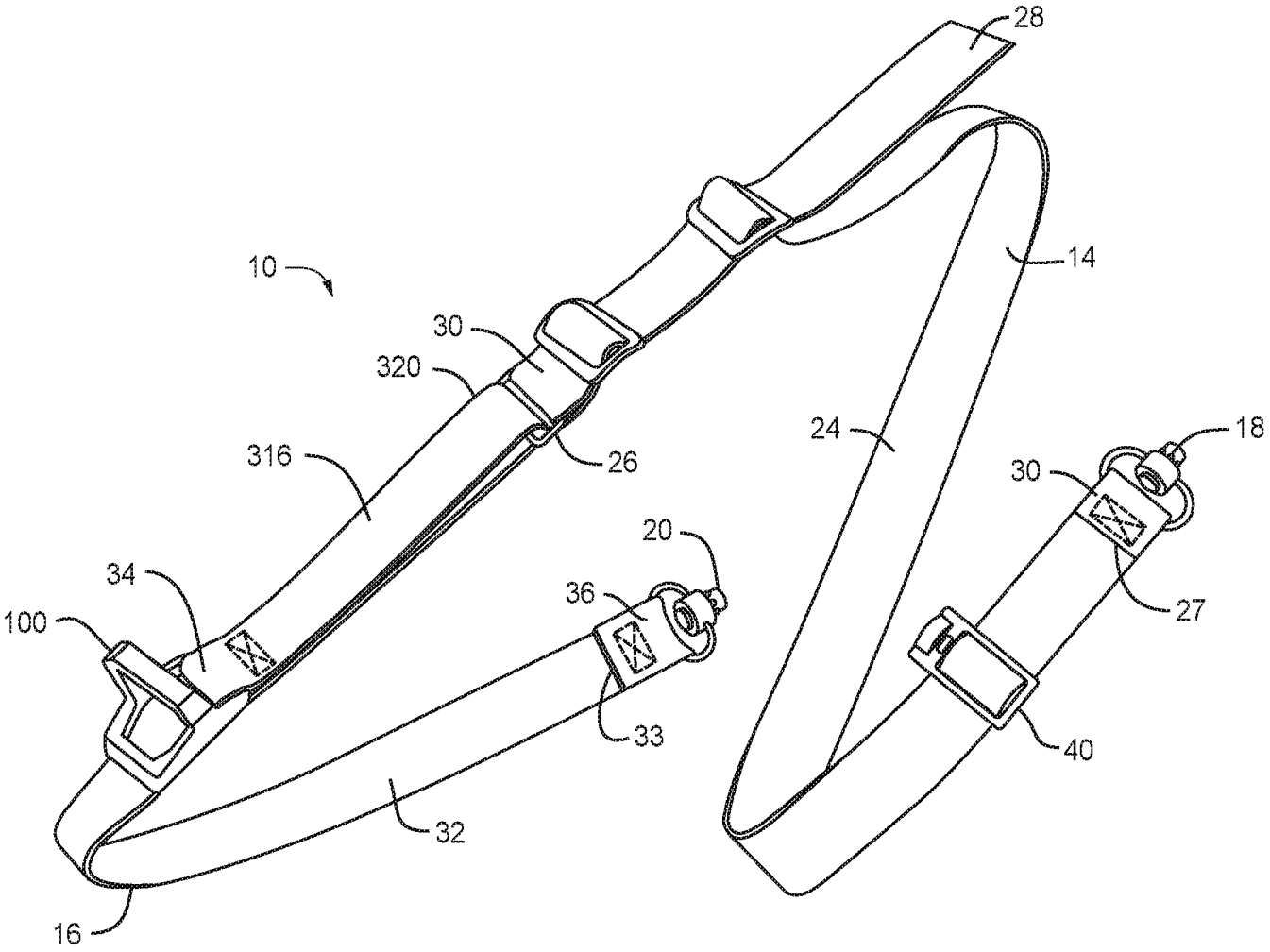
FIGS. 2-6 depict various views of embodiments of a multipoint rifle sling, according to one or more embodiments of the disclosure.
Figure 3:
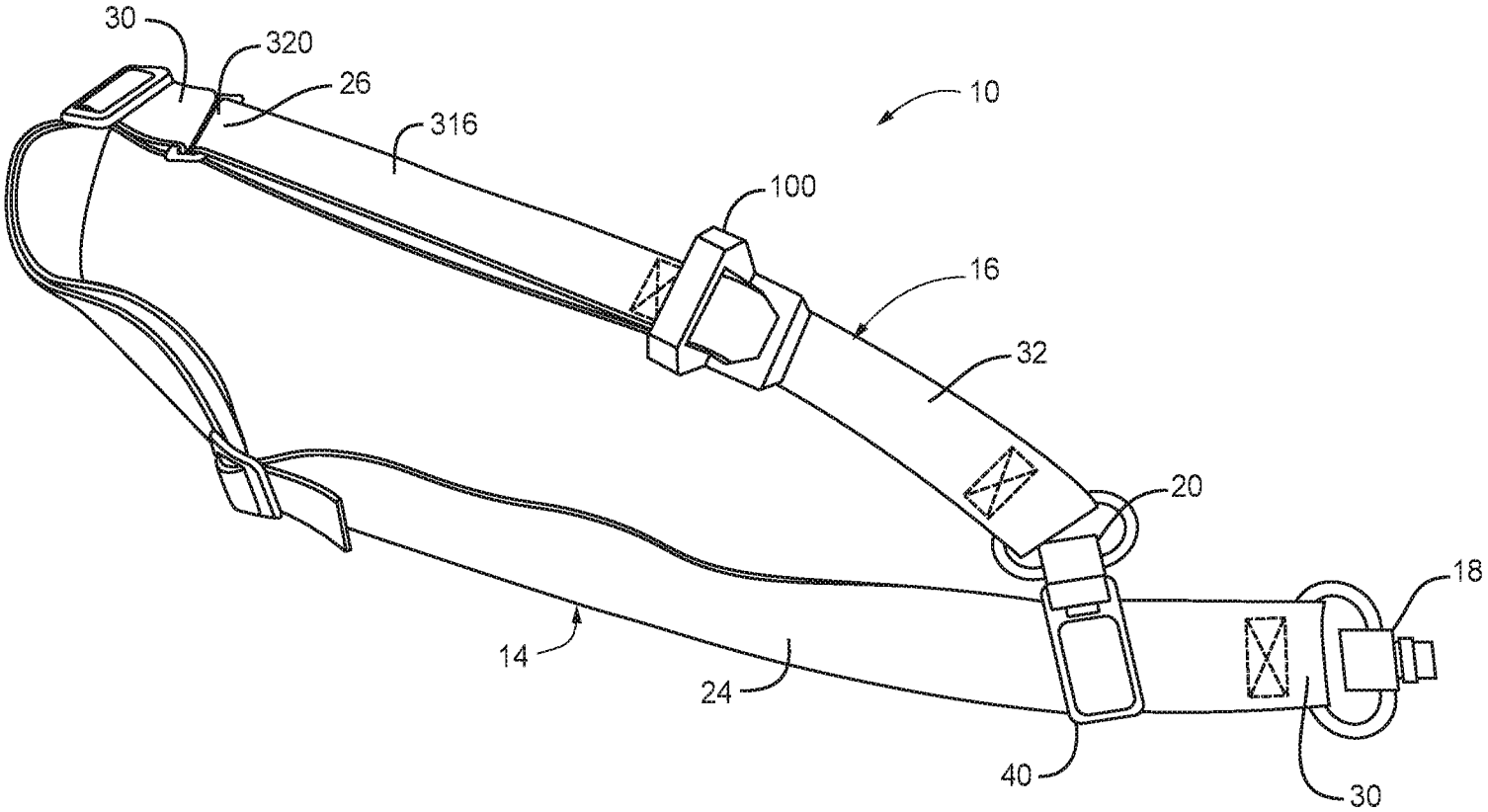

Referring to FIGS. 1-3, a multipoint rifle sling 10 is depicted, according to one or more embodiments of the disclosure. Depicted in FIG. 1, the rifle sling 10 is configured for connection to a weapon system 12, such as a rifle, shotgun, or the like, for supporting the weapon system 12 while being carried by a user. In various embodiments, the sling 10 can support a weapon system in a variety of configurations and orientations. For example, in certain embodiments and described further below the sling 10 is convertible between a single-point configuration and a two-point configuration for supporting the weapon system 12. In addition, single-point and two-point configurations for supporting a weapon system 12 is additional discussed in U.S. Pat. No. 9,577,138 which has been incorporated by reference above.

In one or more embodiments the rifle sling 10 includes a first sling portion 14, a second sling portion 16, and a plurality of connectors 18, 20 for connection to various elements of the weapon system 12. For example, as depicted in FIG. 1, the sling 10 is mounted to both a portion of a buttstock end 21 of the weapon system 12 at a rear connector and to a portion of a forearm end 22 of the weapon system 12 at a forward connector. In addition, in certain embodiments the connectors 18, 20 are configured for connection to other portions of the rifle sling 10 for conversion of the sling 10 between a single-point and two-point configuration.

Depicted in FIGS. 1-3, connectors 18, 20 are push button connectors, however, connectors 18, 20 can include snap hooks, buckle connectors, double lock loops, or any other suitable connector for securably connecting to a portion of the weapon system 12.

In various embodiments, the first sling portion 14 and second sling portion 16 are each lengths of a strap 24 that are connected together by a sling connector 26, such as an eyelet, buckle, or other suitable device, to form a singular rifle sling 10. In some embodiments, and described further below, the sling connector 26 can include a third sling portion that is positioned intermediate the first and second sling portions 14, 16 and connect the two together.

In one or more embodiments, the first sling portion 14 is defined by a strap 24 which extends from a first strap end portion 27 to a second strap end portion 28. In addition, in various embodiments, the first strap end portion 27 and second strap end portion 28 define looped portions of the strap 24 that make up the ends of the first sling portion 14. For example, in various embodiments the first strap end portion 27 and the second strap end portion 28 are looped and secured back onto the strap 24 to form a pair of permanent and/or releasable looped ends 30 of the first sling portion 14.

In such embodiments, one or more of the looped ends 30 of the first sling portion 14 can be formed by sewing, gluing, melting, or otherwise permanently securing the first strap end portion 27 and the second strap end portion 28 back onto a remainder of the strap 24 to form a loop. In certain embodiments, one or more of the looped ends 30 of the first and second strap end portion 28 can be formed by buckling, snapping, velcroing, or otherwise releasably securing the first strap end portion 27 and the second strap end portion 28 back onto a remainder of the strap 24 to form a loop.

In various embodiments, the looped ends 30 of the first sling portion 14 are used to attach various connectors or other elements to the first sling portion 14. For example the connector 18 can be attached to the looped end 30 defined by the first strap end portion 27 and sling connector 20 can be attached to the looped end 30 defined by the second strap end portion 28.

In one or more embodiments the second sling portion 16 is defined by a strap 32 which extends from a first strap end portion 33 to a second strap end portion 34. In various embodiments, the first strap end portion 33 of the second sling portion 16 defines a looped portion that makes up an end of the second sling portion 16. For example, in various embodiments the first strap end portion 33 is looped and secured back onto the strap 32 to form a permanent or releasable looped end 36 of the second sling portion 16.

In various embodiments, the looped end 36 defined by the first strap end portion 33 is used to attach various connectors or other elements to the second sling portion 16. For example the connector 20 can be attached to the looped end 36 defined by the first strap end portion 33 for connection to the forearm end 22 of the weapon system 12.

In addition, in various embodiments, the second sling portion 16 is configured in rapid adjust configuration. As such, the second strap end portion 34 is connected to a rearward crosswise portion of a rapid adjust buckle 100, described further below. In addition, the strap is doubled back around and threaded through the rapid adjust buckle 100, described further below, to define an adjustable loop portion 316 that also defines a second looped end 320 of the second sling portion 16.

In various embodiments, the looped end 320 defined by the adjustable loop portion 316 is used to attach various connectors or other elements to the second sling portion 16. For example the sling connector 26 can be attached to the looped end 320 defined by the adjustable loop portion 316 for connection of the first sling portion 14 to the second sling portion 16.

In one or more embodiments, the first sling portion 14 is a buttstock portion or rear portion of the rifle sling 10. In such embodiments, the connector 18 of the first sling portion 14 is intended for connection to the buttstock end 21 of the weapon system 12 such that when the weapon system and connected rifle sling 10 are carried by a user, the first sling portion 14 and weapon system 12 are generally supported by a user's shoulder, with the strap 24 of the first sling portion 14 extending over the user's shoulder and/or neck.

In certain embodiments, the second sling portion 16 is a forearm portion or forward portion of the rifle sling 10. In such embodiments, the connector 20 of the second sling portion 16 is intended for connection to either the forearm end 22 of the weapon system 12 or to the sling 10 itself, depending upon whether the rifle sling 10 is configured in a single-point or two-point configuration.

For example, depicted in FIG. 1, the rifle sling 10 is in a two-point configuration with connector 20 of the second sling portion 16 connected to the forearm end 22 of the weapon system. Depicted in FIG. 3, the rifle sling 10 is in a single-point configuration, with connector of the second sling portion 16 connected to a multipoint adaptor 40 positioned on the strap 24 of the first sling portion 14. In various embodiments the multipoint adaptor 40 is a buckle or other device positioned along the strap 24 of the first sling portion 14 that includes a receptacle or connector for receiving or interlocking with the connector 20 of the second sling portion 16.

As such, in various embodiments, and in either the single-point or two-point configuration, the rifle sling 10 is configured to generally support the weapon system 12 via a user's shoulder, with the strap 24 of the first sling portion 14 draped over the shoulder and/or neck and extending down and around the user's back and torso with the strap 32 of the second sling portion 16 extending under the user's arm and connecting either back to the weapon system 12 or to the multipoint adaptor 40.

As such, in one or more embodiments, the strap 24 of the first sling portion 14 has a relatively wide webbing for improved weight dispersal as the strap rides over a user's shoulder and/or neck. In such embodiments, this use of a wider webbing for the strap 24 of the first sling portion 14 improves comfort and overall usability for the rifle sling 10. In various embodiments the strap 35 possess a width of at least 1.25 inches for such improved weight disperal. However, in certain embodiments the strap 24 could be made wider as desired for improved weight dispersal.

In certain embodiments the strap 32 of the second sling portion 16 possesses a smaller width than the strap 24 of the first sling portion 14. In such embodiments, the rifle sling 10 uses different webbing widths in the front, and rear parts of the sling 10. This reduces bulk and weight of the rifle sling 10, and reduces the size of the rapid adjust buckle 100. In addition, in various embodiments, by connecting the relatively wider rearward first sling portion 14 with the narrower forward second sling portion 16 the sling 10 can realize combined benefits. For instance, in such configurations the front of the sling 10 is lightweight and compact while the rear section of the sling 10 is wider and more comfortable to wear. In certain embodiments the strap 32 of the second sling portion 16 is approximately 1 inch wide. However, in various embodiments the strap 32 of the second sling portion 16 could be made narrower, or in some instances, wider as desired based upon the preferred design of the sling.

Figure 4:
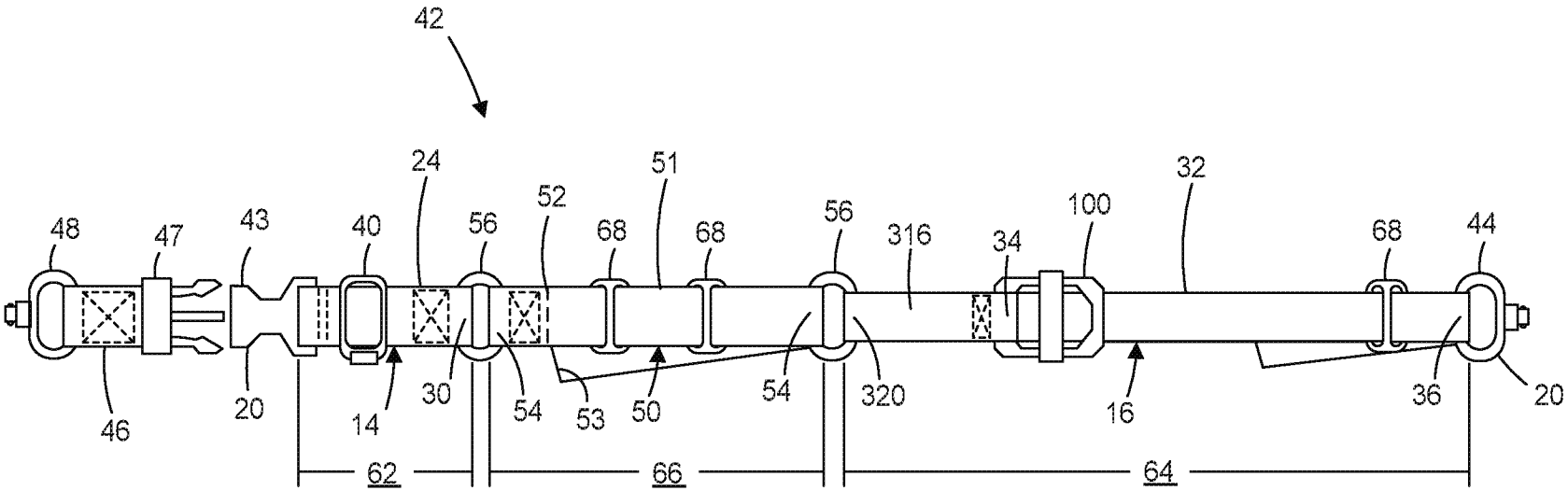

Referring to FIG. 4, a multipoint sling 42 is depicted, according to one or more embodiments of the disclosure. Multipoint sling 42 is similar to multipoint sling 10 depicted in FIGS. 1-3. As such, like elements are notated with like reference numerals. For example, multipoint sling 42 includes a first sling portion 14, a second sling portion 16, and a plurality of connectors 18, 20 for connection to various elements of a weapon system.

Depicted in FIG. 4, connectors 18, 20 include a buckle connector 43 and a push button connector 44, respectively. In one or more embodiments buckle connector 43 is configured for connection to an adaptor portion 46 including a corresponding connector 47 to the buckle connector 43 and a length of strap connected to an adaptor 48 that adapts the buckle connector 43 for connecting to a weapon system, as described above.

As described above, the first sling portion 14 and second sling portion 16 are each lengths of straps 24, 32. However, depicted in FIG. 4, the first sling portion 14 and the second sling portion 16 are connected together by a sling connector in the form of a third sling portion 50 that is positioned intermediate the first and second sling portions 14, 16 and connects the two together.

In one or more embodiments the third sling portion 50 is defined by a strap 51 which extends from a first strap end portion 52 (depicted as a dashed line on the opposite side of the strap 51) to a second strap end portion 53. In addition, in various embodiments, the first strap end portion 52 and second strap end portion 53 define looped portions of the strap 51 that make up the ends of the third sling portion 50. For example, in various embodiments the first strap end portion 52 and the second strap end portion 53 are looped and secured back onto the strap 51 to form a pair of permanent and/or releasable looped ends 54 of the third sling portion 50.

As described above with reference to the first and second sling portions 14, 16, in various embodiments the looped ends 54 of the third sling portion 50 are used to attach various connectors. For example, the looped ends 54 defined by the third strap end portion 50 are attached to a pair of eyelet connectors 56 that are in turn connected to one of the first and second sling portions 14, 16 for connecting the first and second sling portions 14, 16 and forming a singular rifle sling 42.

In one or more embodiments, the first sling portion 14, second sling portion 16, and third sling portion 50 each have a sling length 62, 64, 66 that combines to form the overall length of the rifle sling 42. In addition, in one or more embodiments one or more of the sling portions have an adjustable length. For example, depicted in FIG. 4 and in FIGS. 1-3, the second sling portion 16 is configured for rapid adjustment of its length via buckle 100. As such, the length 64 of second sling portion 16 is quickly and easily adjustable by moving the buckle 100 in either direction along a longitudinal axis of the rifle sling 42 to increase or decrease the size of the adjustable loop portion 316 of the second sling portion 16 and, in turn, increase or decrease the length of the second sling portion 16.

In various embodiments, and depicted in FIG. 4, the length of the second sling portion 16 can be additionally adjusted via an adjustment buckle 68 positioned on the strap 32 and securing a loose end of the strap 32 that is looped back around to form looped end 36 of the second sling portion 16. In various embodiments the amount of strap looped back around and secured to the strap 32 can be adjusted via the adjustment buckle 68 to affect the maximum length of the second sling portion 16.

Similarly, depicted in FIG. 4, the third sling portion 50 has an adjustable length due to the presence of adjustment buckles 68 that secure loose strap used to form the looped end 54 of the third sling portion 50.

In various embodiments each sling portion has a maximum length that corresponds to the maximum length of the straps 24, 32, 51 that make up each corresponding portion. In certain embodiments the length of the strap 24 of the first sling portion 14 is 4.25 inches. In certain embodiments the length of the strap 32 of the second sling portion 16 is 28 inches. In certain embodiments the length of the strap 51 of the third sling portion 50 is 28 inches. However, various types and lengths of strap can be used for each portion of the sling depending upon the preferences of the user and design of the rifle sling. As such, in various embodiments the length of straps 24, 32, 51 could each be larger or smaller depending upon the preferences of the user.

Figure 5:
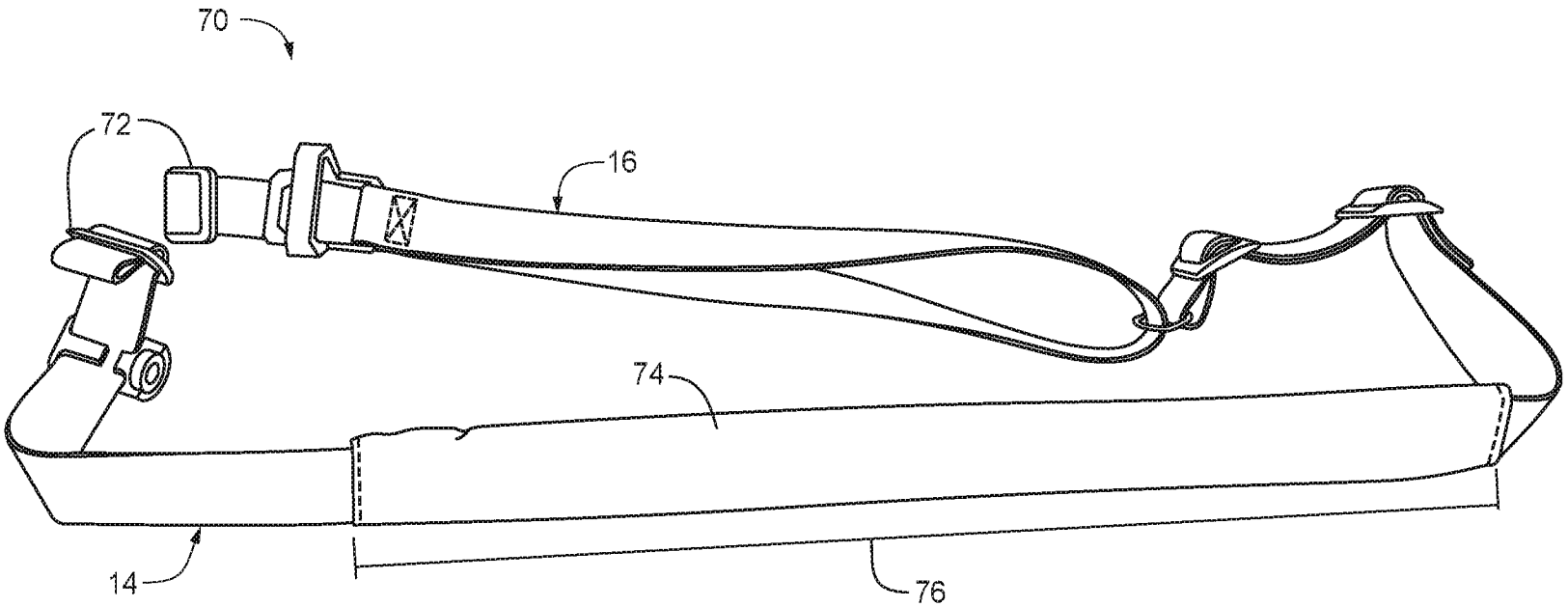

Referring to FIG. 5, a multipoint rifle sling 70 is depicted, according to one or more embodiments. Rifle sling 70 is similar to rifle sling 10 depicted in FIGS. 1-3. As such, like elements are notated with like reference numerals. For example, multipoint sling 70 includes a first sling portion 14, a second sling portion 16, and a plurality of connectors 72 for connection to various elements of a weapon system.

In one or more embodiments, the first sling portion 14 includes a padded portion 74. In addition, in certain embodiments, the padded portion is elastic and upon pressure expands in both directions along the longitudinal axis of the rifle sling. In one or more embodiments, the padded portion includes a material such as neoprene is used for padding, with a perimeter sewn with a binding edge, and combined by sewing to another elastic material in order to maintain it's length.

In certain embodiments, the padded portion 74 includes only two materials, a flat inner elastic webbing core, with an outer sleeve of slick 4-way stretch nylon fabric. The inner and outer core are only connected to each other at the ends of the sling, where they are joined to the non-flexible webbing. In various embodiments, allowing these two stretch materials to work independent of each other eliminates failure points and unneccessary components sewn together along the stretch section length. As a result, this configuration greatly reduces bulk and system complexity, while increasing durability of the rifle sling 70.

In one or more embodiments, the padded portion 74 has a length 76 that makes up a portion of the total length of the first sling portion 14. In various embodiments the length 76 of the cushion stretch section is specific to make contact over the shoulder of a user both in single-point and two-point configurations, as to not abrade against the neck in use. For example, in one or more embodiments the length 76 of the cusion makes up 50% to 80% of the total length of the first sling portion 14.

In various embodiments, while the rifle sling 70 and weapon system are in operation, the elastic properties of the padded portion 74 can be used to hold tension on the weapon system to steady a sight picture. For example, in certain embodiments, by cincing the sling 70 tight to the user's body, then pushing the rifle slightly away from the shoulder, a sight picture is instantly steadied by the tension held in the elastic materials of the padded portion 74.

In certain embodiments, in operation, when walking, jogging or running with a weapon system carried by the rifle sling 70, the padded portion 74 allows the weapon weight to load and unload in unison with each step. In various embodiments the elastic materials of the padded portion 74 are specifically situated over the shoulder, near the neck, which allow this section to extend and contract at a critical physical contact point to the body. Destressing this pressure point greatly enhances comfort and usability of the rifle sling 70. In one or more embodiments the padded portion 74 is both flat and slick, as to not abrade against bare skin, or catch/snag on soldier worn gear such as a tactical vest.

Figure 6:
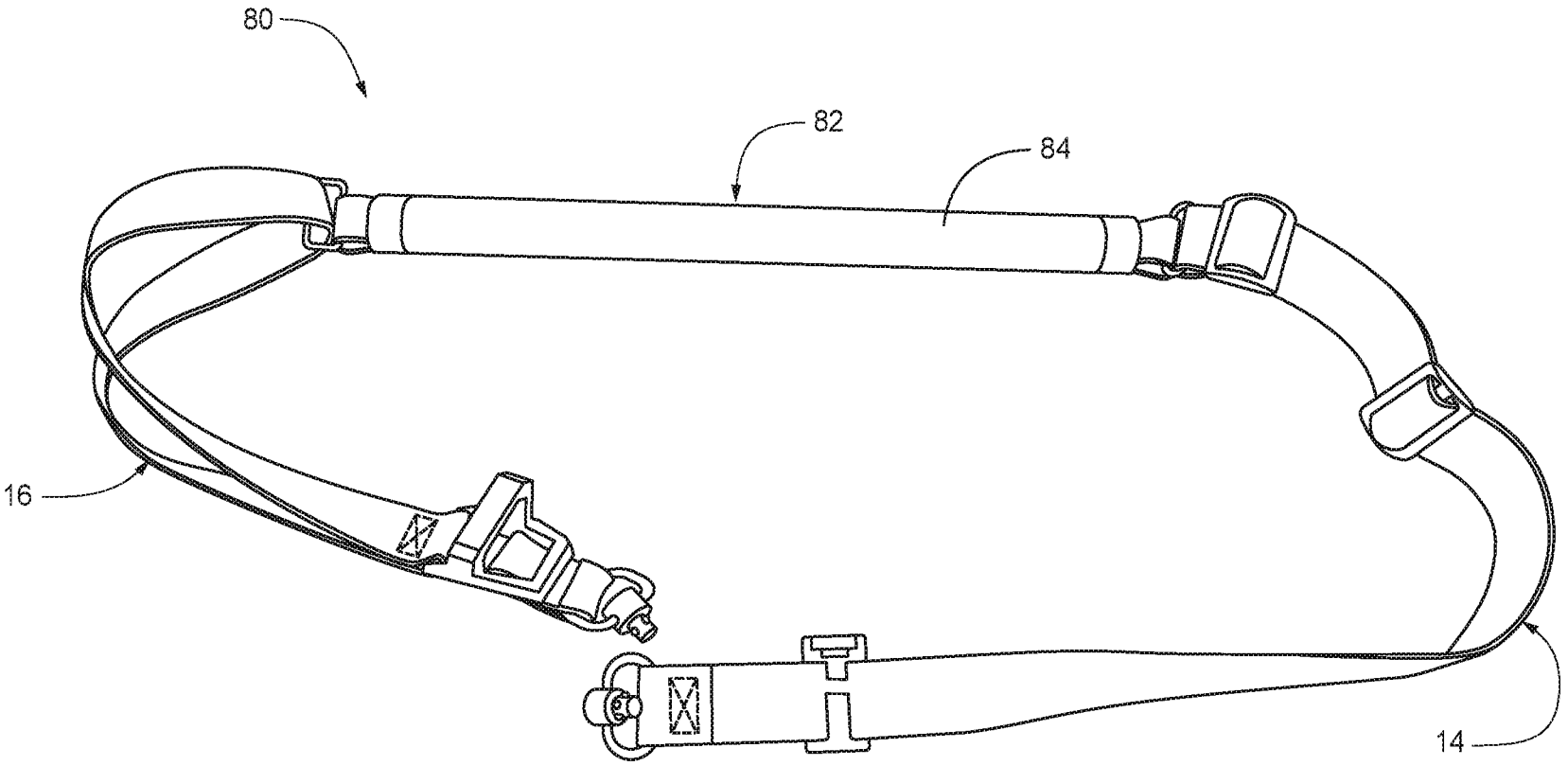

Referring to FIG. 6, a multipoint rifle sling 80 is depicted, according to one or more embodiments. Rifle sling 80 is similar to rifle sling 10 depicted in FIG. 4. As such, like elements are notated with like reference numerals. For example, multipoint sling 80 includes a first sling portion 14, a second sling portion 16, and a plurality of connectors for connection to various elements of a weapon system.

In addition, the rifle sling 80 includes a third sling portion 82 in the form of an elastic portion 84 that extends from a first end to a second end. In various embodiments the first and second end of the elastic portion are connected to looped ends of the first and second sling portion 14, 16 to connect the two together to form a singular rifle sling 80.

Similar to rifle sling 70 as described above with reference to FIG. 5, the elastic portion 82 is elastic and upon pressure expands in both directions along the longitudinal axis of the rifle sling 80. In one or more embodiments, the elastic portion 82 includes a material such as neoprene is used for padding, with a perimeter sewn with a binding edge, and combined by sewing to another elastic material in order to maintain it's length.

Referring to FIGS. 7-12 a rapid adjust buckle 100 for use in a multipoint rifle sling is depicted, according to one or more embodiments. In various embodiments the buckle 100 includes a main buckle portion 104 having a pair of side portions 108 and a plurality of crosswise portions 112 that extend between the side portions 108. In various embodiments, the crosswise portions 112 extend normally between the side portions 108.

Figure 7:
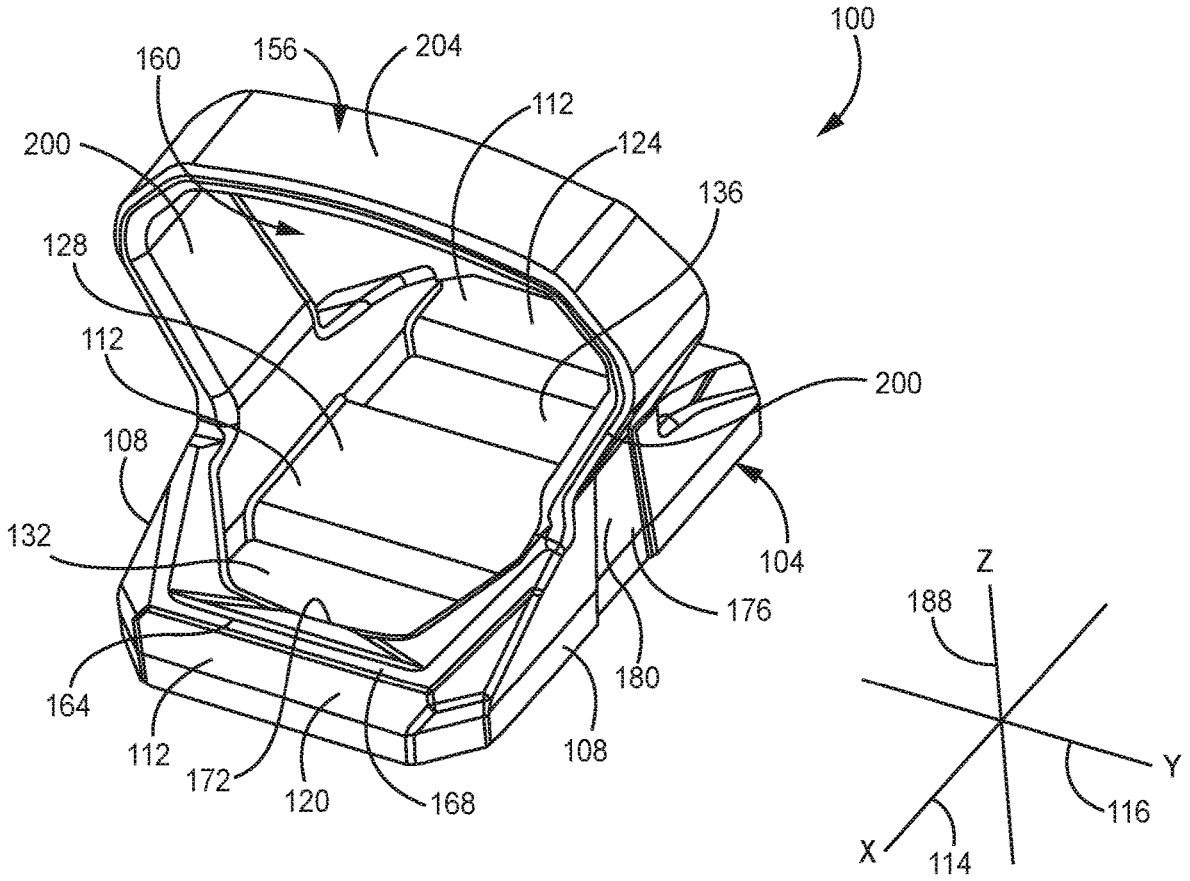
FIGS. 7-12 depict various views of a rapid adjust buckle, according to one or more embodiments of the disclosure.
Figure 8:
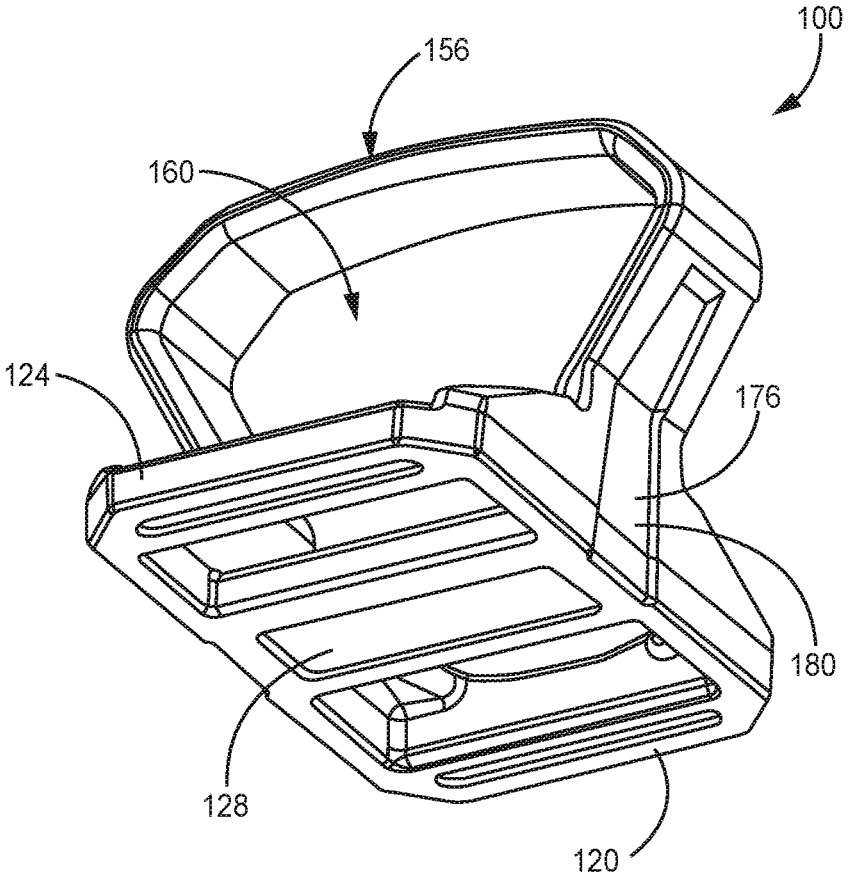
Figure 9A:
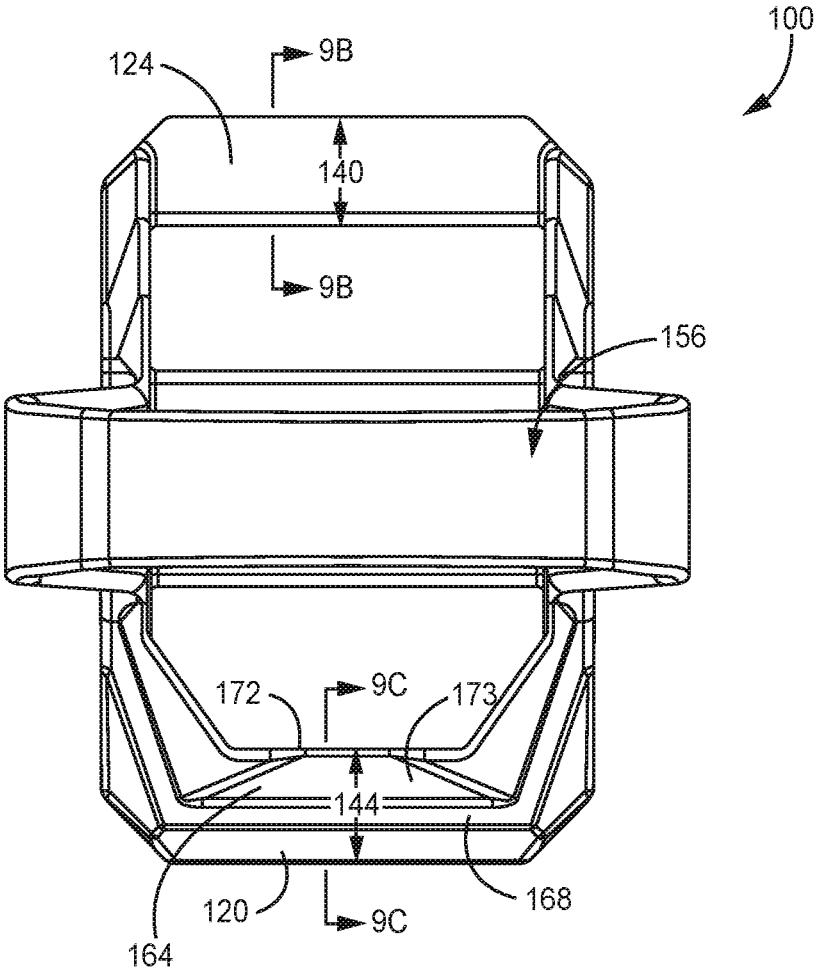
Figure 9B:
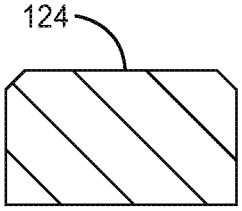
Figure 9C:
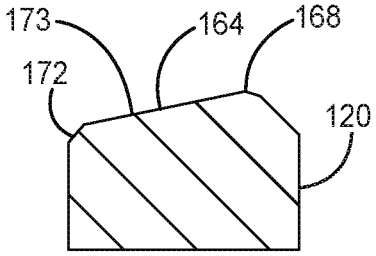
Figure 10:
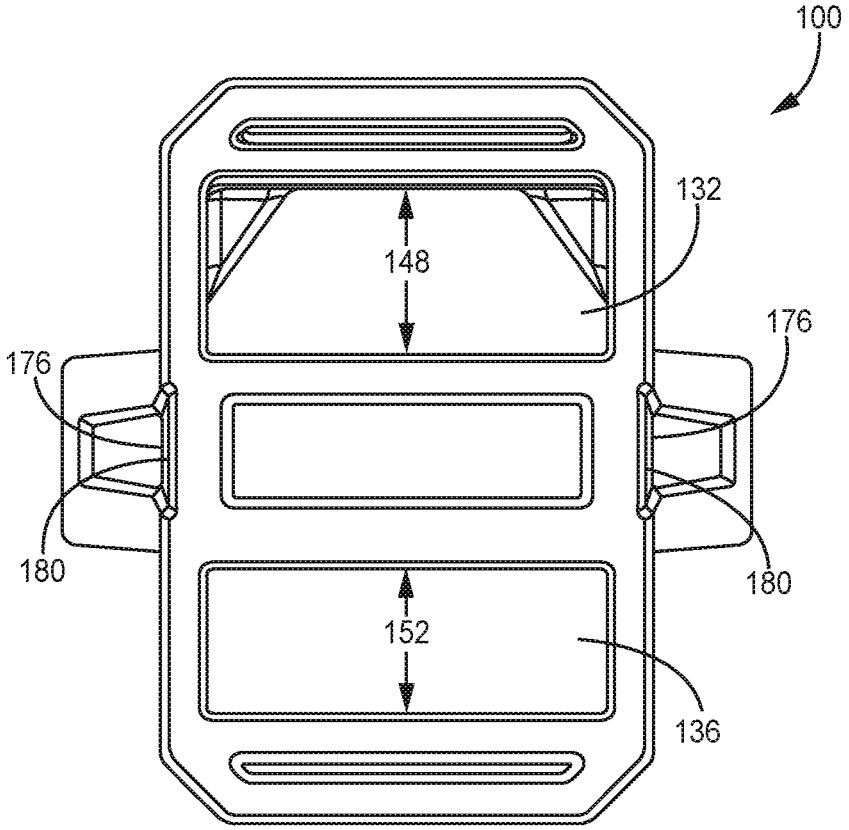

In one or more embodiments, the side portions 108 extend parallel to one another in a first direction, depicted in FIG. 7 as along an X-axis 114, while the plurality of crosswise portions 112 extend parallel to one another in a second direction and perpendicular to the pair of side portions 108, depicted in FIGS. 7-12 as along a Y-axis 116.

In one or more embodiments, the crosswise portions 112 include a forward crosswise portion 120, a rearward crosswise portion 124, and a third crosswise portion or beam portion 128 positioned intermediate the forward and rearward crosswise portions 120, 124.

In various embodiments, the crosswise portions 112 are spaced apart from one another in the first direction to define at least a pair of buckle apertures including a forward buckle aperture 132 defined between the forward crosswise portion 120 and the beam portion 128 and a rearward buckle aperture 136 defined between the beam portion 128 and the rearward crosswise portion 124. In one or more embodiments, the crosswise portions 112 each have a thickness or width in the X-axis 114 direction that defines the width and/or shape of each of the buckle apertures. For example, in certain embodiments, the rearward crosswise portion 124 has a width 140 greater than a width 144 of the forward crosswise portion 120. As such, in various embodiments, the forward buckle aperture 132 has an aperture width 148 larger than an aperture width 152 of the rearward buckle aperture 136.

However, in some embodiments, the width and/or shape of the buckle apertures is defined by the position of the bream portion 128 between the forward and rearward crosswise portions 120, 124. For example, in certain embodiments, the beam portion 128 is positioned closer or more rearwardly along the X-axis 114 such that the beam portion 128 defines the forward buckle aperture 132 as having an aperture width 148 larger than an aperture width 152 of the rearward buckle aperture 136. In such embodiments the widths 140, 144 of the rearward crosswise portion 124 and the forward crosswise portion 120 could be substantially the same. In certain embodiments, the width and/or shape of the buckle apertures can be defined by both the position of the beam portion 128 and relative width differentials between the forward crosswise portion 120 and the rearward crosswise portion.

In certain embodiments, the aperture width 148 of the forward buckle aperture 120 is in the range of 10% to 50% larger than the aperture width 152 of the rearward buckle aperture 136. In some embodiments, the aperture width 148 of the forward buckle aperture 132 is approximately 33% larger than the aperture width 152 of the rearward buckle aperture 136. In certain embodiments the aperture width 148 of the forward buckle aperture 132 is substantially the same as the aperture width 152 of the rearward buckle aperture 136.

In one or more embodiments the buckle 100 includes a handle portion 156. In various embodiments, handle portion 156 may form an arcuate shape, rectangular shape, or other shape. In one or more embodiments the handle portion 156 is formed from a piece of material extending between each of the side portions 108 and over the main buckle portion 104 to define a loop or handle aperture 160 with the main buckle portion 104. Depicted in FIG. 7, in various embodiments the handle aperture 160 is substantially perpendicular with the X-axis 114.

In one or more embodiments the main buckle portion 104 includes one or more gripping portions. In various embodiments, and described further below, gripping portions are portions of the buckle 100 configured to provide sections or areas of the buckle 100 that are easily graspable by a user for manipulating the buckle 100 as a part of a rifle sling, belt, or other assembly.

For example, depicted in FIGS. 7, 9A, 9B, and 9C, in one or more embodiments the forward crosswise portion 120 includes a first gripping portion 164 defined by a portion of raised material that tapers rearwardly from an apex 168 to a rearward edge 172 of the forward crosswise portion 120. As such, the first gripping portion 164 defines a ridge or frictional area 173 for a user to easily grasp onto the buckle 100 even while a user is wearing gloves, in wet conditions, or in other conditions which would traditionally impede manipulation of the buckle 100. Depicted in FIGS. 9A and 9C, the frictional area 173 includes the tapered portion between the apex 168 and the rearward edge 172 of the forward crosswise portion 120. In such embodiments, the frictional area 173 facilitates the placement of a user's thumb or finger to grip or otherwise manipulate the position of the buckle 100 for sling length adjustment, as described herein. In various embodiments, the first gripping portion 164 is in contrast with the rearward crosswise portion 124. For example, depicted in FIG. 9B, the rearward crosswise portion 124 does not include a taper and instead includes a flat top and bottom surface.

In some embodiments the side portions 108 include a second gripping portion 176. Depicted in FIGS. 7-12, second gripping portion 176 is defined by a pair of recesses 180 in side portions 108 to form a relatively high friction region at the interface of the recesses 180 with the non-recessed portions of the side portions 108 for assisting a user in grasping the sides of the main buckle portion 104.

In addition, in certain embodiments, the gripping portions can include additional frictional elements, such as raised bumps or other elements configured to increase the surface friction of portions of the buckle 100. For example, in certain embodiments the first and/or second gripping portions 164, 176 could additionally include a roughened surface, bumps, or other friction increasing elements.

In one or more embodiments, elements of the buckle 100 are comprised of a polymer material, such as a polyester. In one such embodiment, buckle 100 comprises a generally flexible plastic or polymeric material. In embodiments, buckle 100 may comprise a copolyester comprising PET, PCTG, PCTA, PETG or PCT. In one or more embodiments, buckle 100 may comprise a thermoplastic polyester elastomer, such as the thermoplastic polyester elastomer Hytrel® or Hytrel® RS manufactured by E.I. du Pont de Nemours and Company (DuPont®).

In such embodiments, the thermoplastic polyester elastomer provides an impact-resistant material for buckle 100 that can flex in multiple directions over many cycles, while still retaining its original shape. Such a material provides durability advantages over other traditionally-used flexible materials, such as rubber. In addition, in one or more embodiments the buckle 100 is a single unitary piece of material. For example, in one or more embodiments handle 156 and the main buckle portion 104 formed together from an injection molding, insert molding, or other suitable molding process.

Figure 11A:
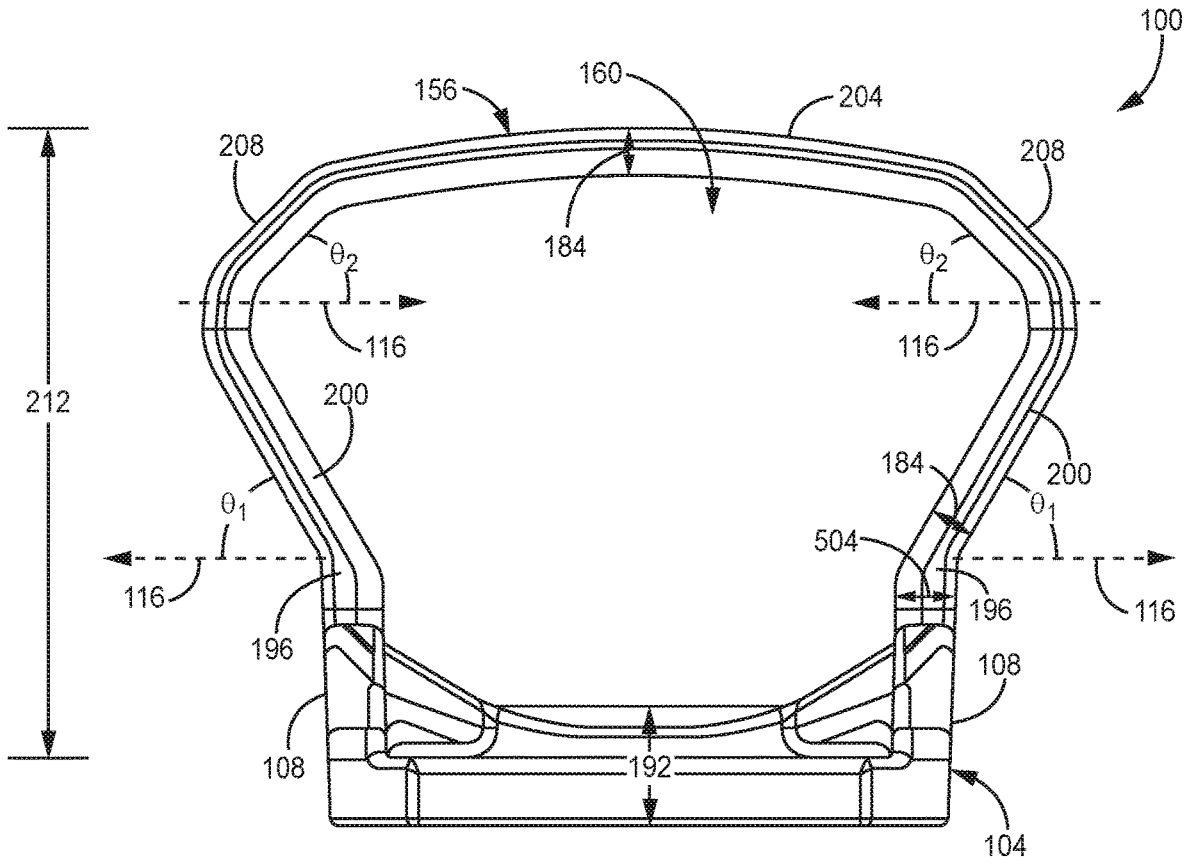
Figure 11C:
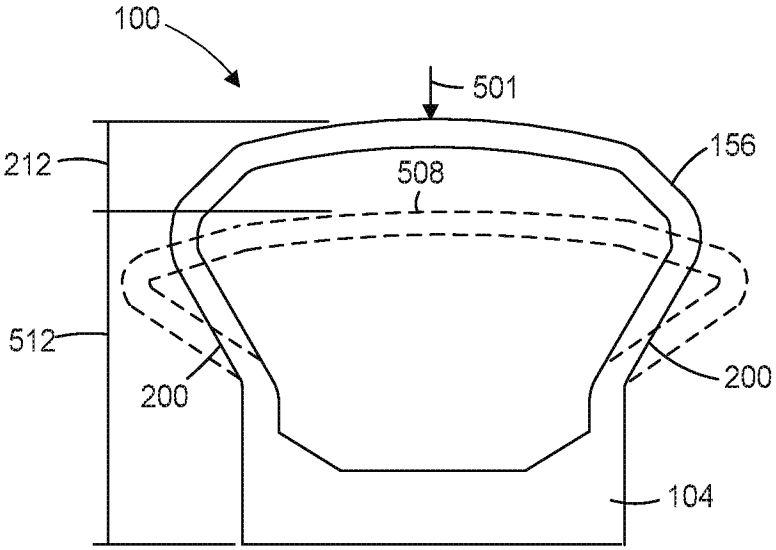
Figure 11B:
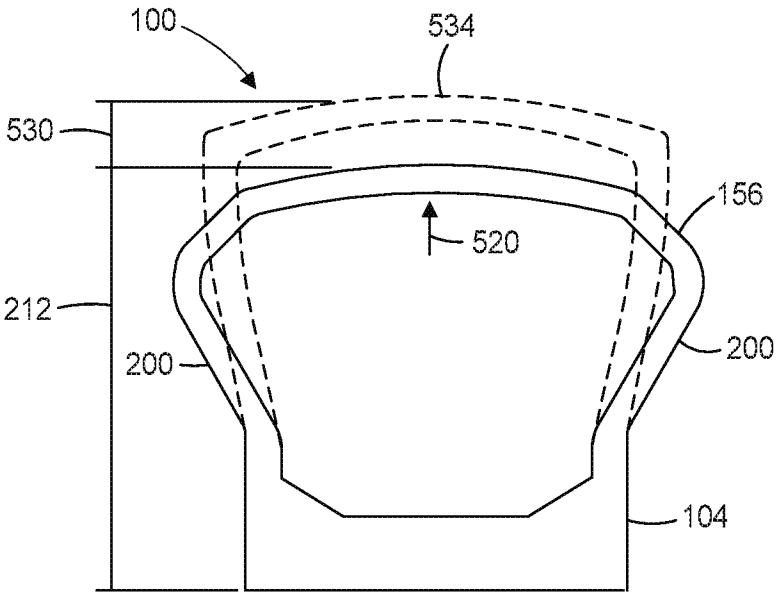

Referring to FIGS. 11A-11C, in various embodiments, the handle 156 and elements of the handle 165 have a handle thickness 184 such that the handle 156 forms a flexible but biased shape that is configured to fold or compress downwardly, in a direction along a Z-axis 188 towards the main buckle portion 104, depicted in FIG. 11C, in response to a compressing force 501, but returns to a normal or uncompressed shape, as depicted in FIGS. 7-12, when the compressing force is relieved. In one or more embodiments the handle thickness 184 is in the range of 33% to 75% of a thickness 192 of the main buckle portion 104. In some embodiments the handle 156 has a thickness 184 in the range of 0.25 centimeters to 0.75 centimeters.

In one or more embodiments the handle 156 includes a pair of vertically extending portions 200 connected to the side portions 108 and each angled away from one another at an angle θ1 with respect to the Y-axis 116. In addition, in one or more embodiments, the handle 156 includes a horizontally extending or crosswise handle portion 204 extending between each of the vertically extending portions 200. In various embodiments the crosswise handle portion 204 is connected to each of the vertically extending portions 204 with an angled portion 208 each extending towards one another at an angle θ2 with respect to the Y-axis 116.

Further, in one or more embodiments handle 156 is configured to neatly fold or neatly compress the handle 156 into a relatively flattened shape. For example, in one or more embodiments the handle 156 is designed having a plurality of flexible or jointed connection points 196 with the main buckle portion 104 configured to flatten the overall shape or profile of the handle 156 when the handle portion 156 is compressed towards the main buckle portion 104.

As used herein, the jointed connection points 196 refer to structural features in the buckle 100 that allow the handle portion 156 to move, flex and/or compress when exposed to pressure. For example, depicted in FIG. 11A, the jointed connection point 196 is defined by a thickness differential between a thickness 504 at the interface of the handle portion 156 with the main buckle portion 104 and the handle thickness 184 of the remainder of the handle portion 156. In various embodiments, thickness 504 is larger than the handle thickness 184, however, in certain embodiments, thickness 504 could be smaller than the handle thickness 184. In one or more embodiments, the handle thickness differential provides for a natural joint where the pair of vertically extending portions 200, can rotate, flex, or otherwise move.

As such, in one or more embodiments, when compressed, the vertically extending portions 200 flair outwardly while the angled portions 208 of the crosswise handle portion 204 flatten to form a generally flattened handle shape, depicted in FIG. 11C, by flattened shape 508. In one or more embodiments, the flattened handle shape reduces a vertical height 212 of the handle 156 to a flattened handle height 512. In various embodiments the flattened handle height 512 in the range of 30% to 90% of the vertical height 212 when the handle 156 is uncompressed.

Figure 12:
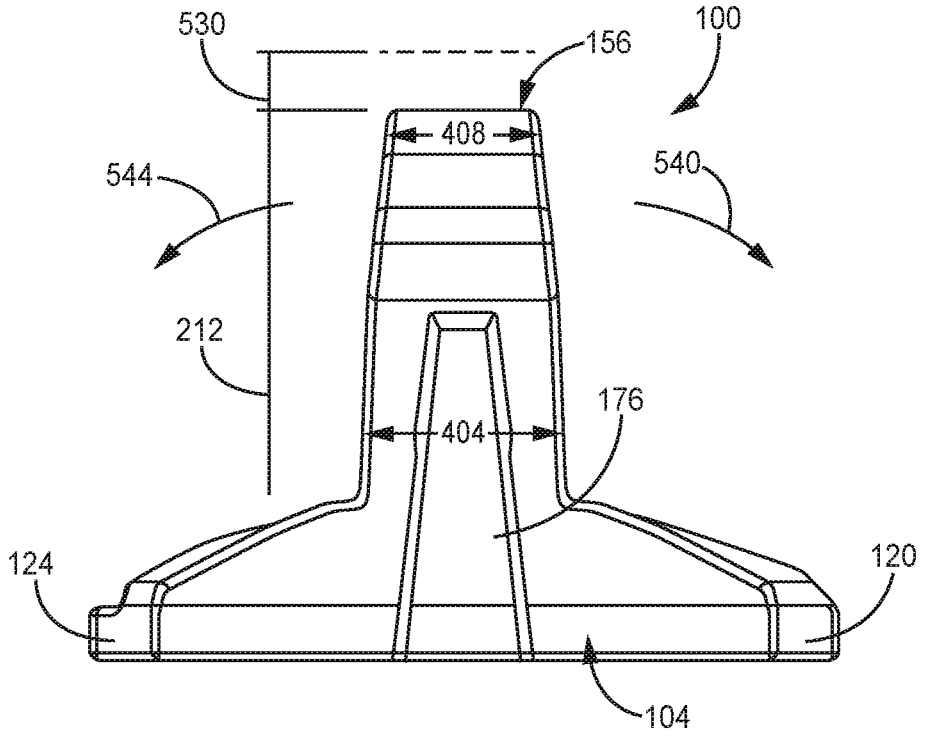

In addition, in various embodiments, the handle 156 is configured to extend outwardly, in the Z-axis direction in response to a pulling force 520, to an extended configuration 534. For example, depicted in FIG. 11B, when the handle portion is exposed to a pulling force 20 the vertically extending portions substantially straighten vertically to extend the height of the handle portion 156 upwardly to an extended height 530. Referring to FIG. 12, in various embodiments, and described further below, the buckle 100 is manipulated by a user pulling or pushing the buckle in a direction along the X-axis to adjust the length of a sling portion configured with the buckle 100. In such embodiments, the extended height 530 of the handle portion 156 allows for a greater moment force to be applied on the handle in either direction 540, 544 by the user.

Referring specifically to FIG. 12, in various embodiments the handle 156 has a base portion thickness 404 at the jointed connection point that tapers to more narrow top thickness 408 at the top of the handle portion 156. In such embodiments, the base portion thickness 404 is thick enough such that the handle portion 156 resists axial movement of the handle 156 such that the handle does not significantly displace in the X-axis direction when a moment force is applied to the handle in either direction 540, 544. In one or more embodiments, the base handle thickness 404 is in the range of 20% to 40% of a total thickness of the length of the main buckle portion 100 in the X-axis direction. As such, in various embodiments, the handle 156 is limited such that all movement/flexibility is limited to the Z-axis and Y-axis directions and the handle does not significantly flex in the X-axis direction.

Figure 13:
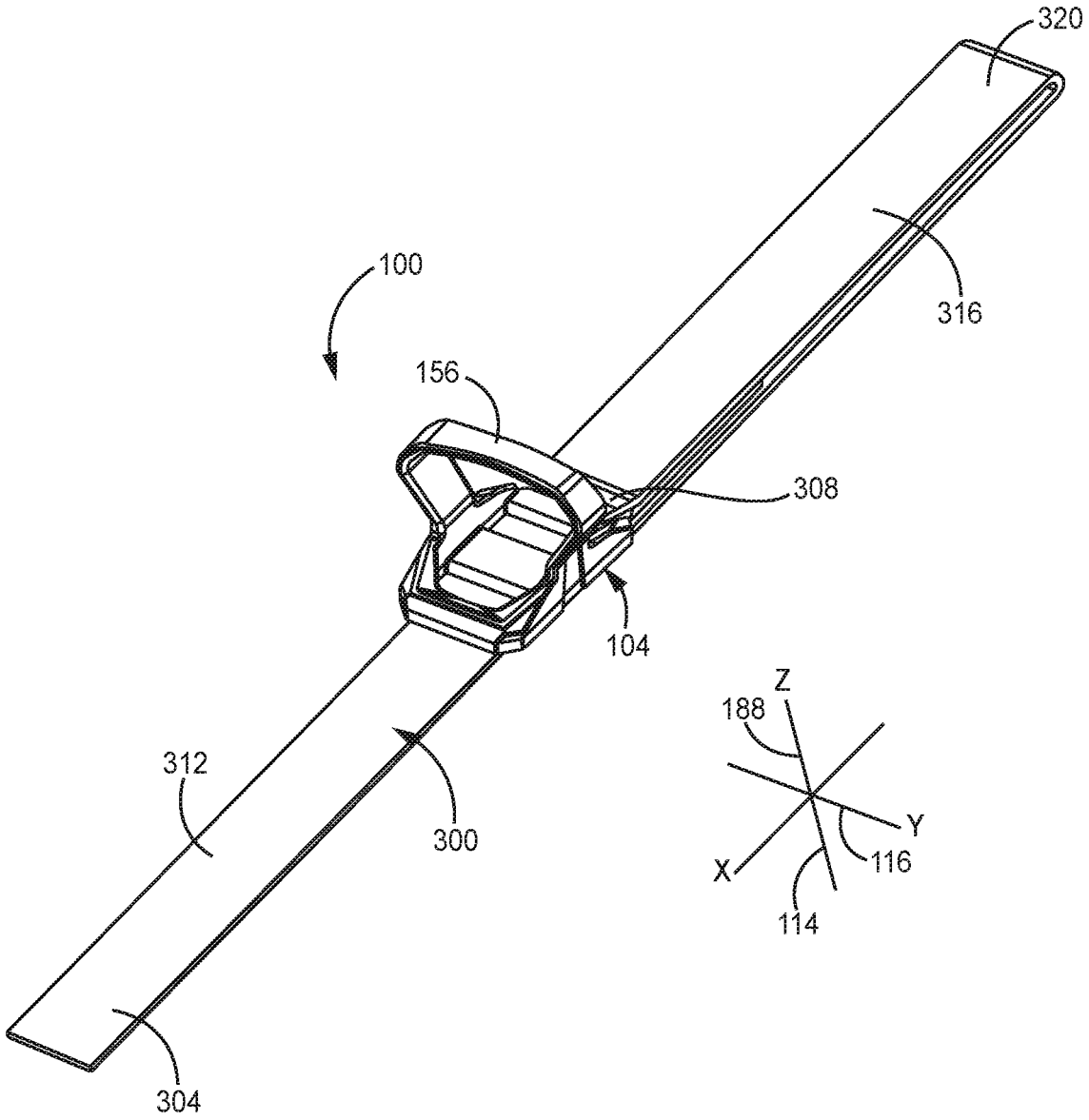
FIGS. 13-16 depict various views of a rapid adjust buckle and a strap, according to one or more embodiments of the disclosure.
Figure 14:
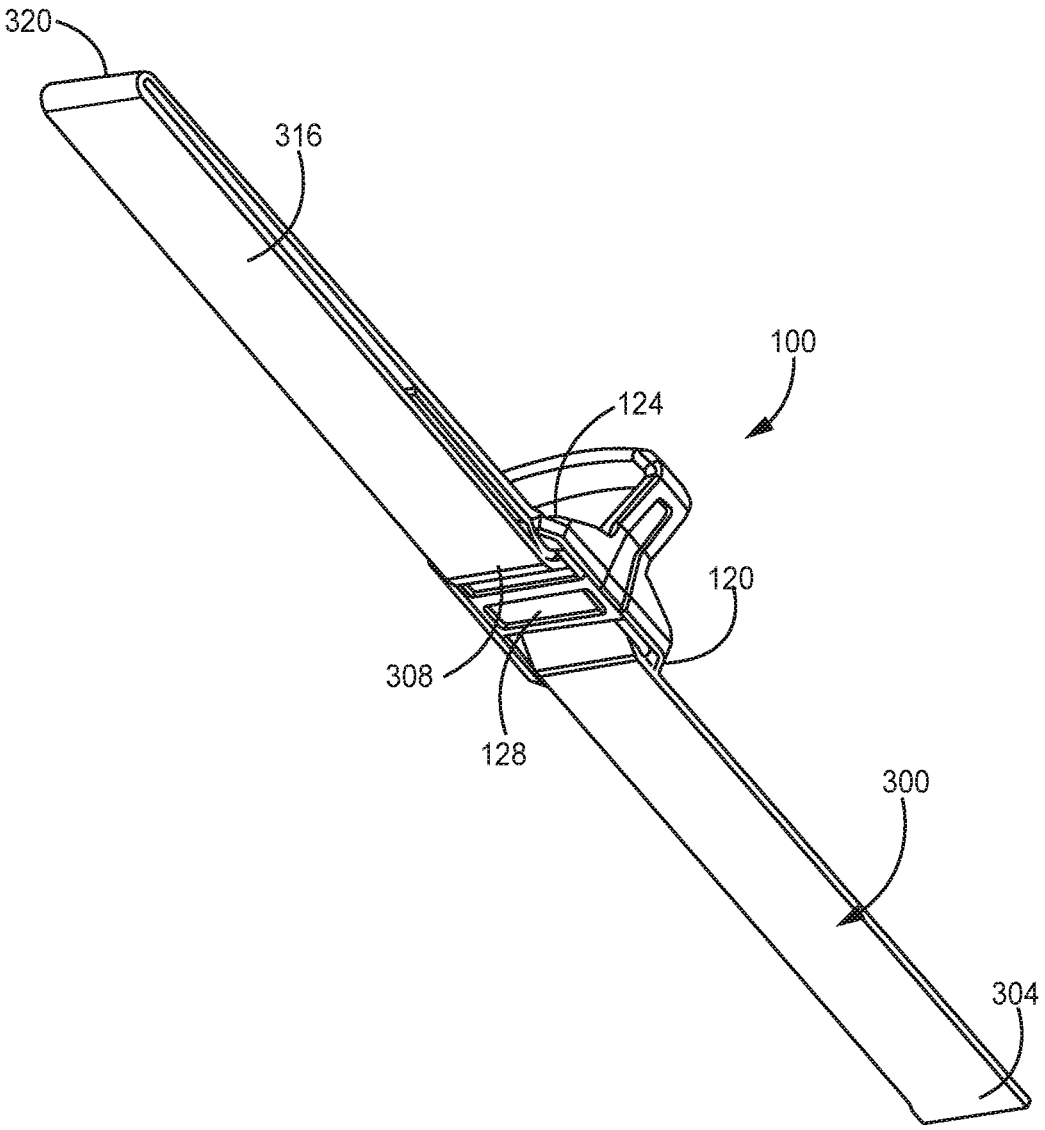
Figure 15:
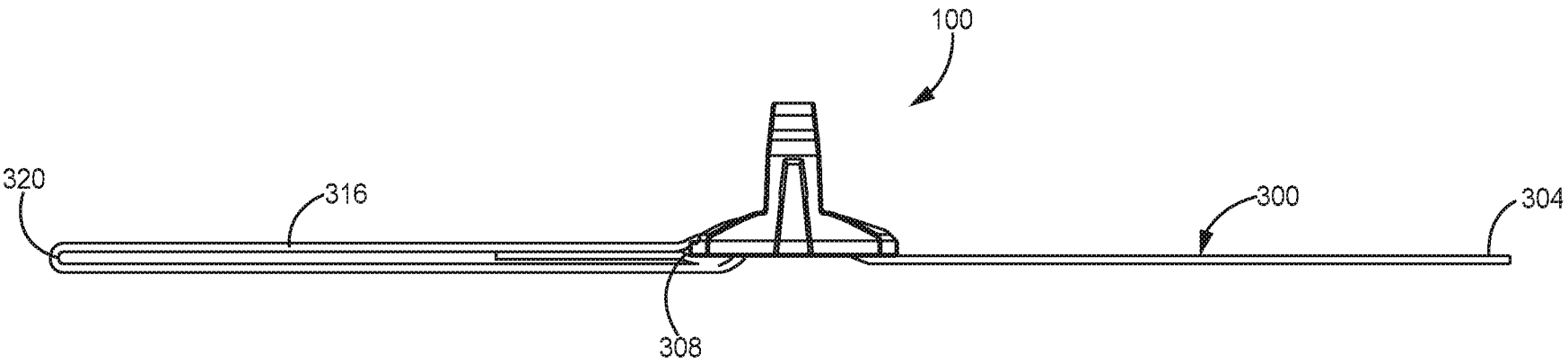
Figure 16:
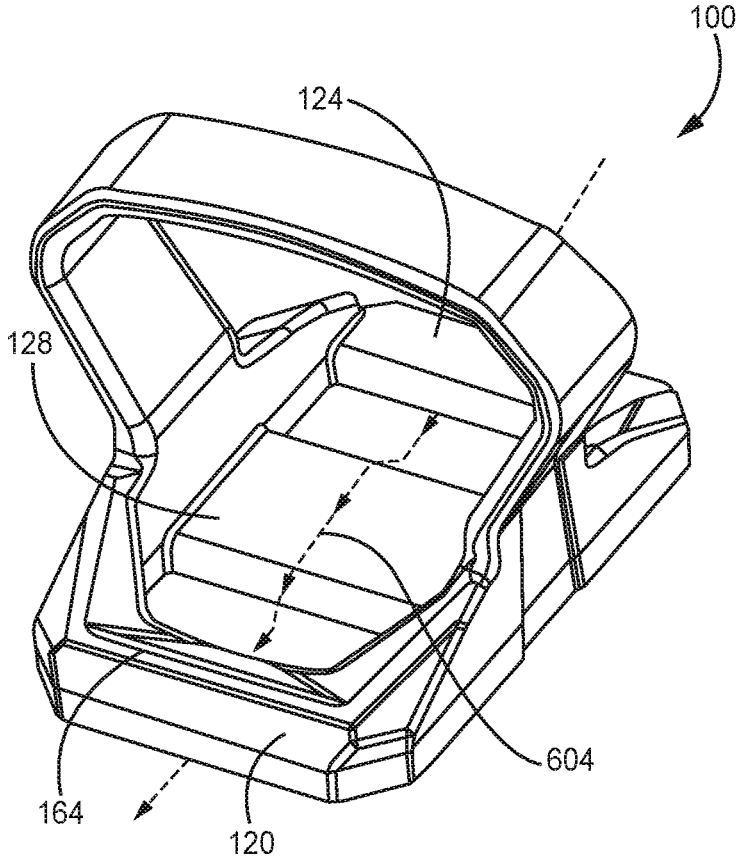

FIGS. 13-15 depict a sling portion including a rapid adjust buckle 100 and a strap 300, according to one or more embodiments of the disclosure. As described above, in one or more embodiments, strap 300 is a continuous length of flexible material extending from a first end portion 304 to a second end portion 308. In one or more embodiments, the buckle 100 can be combined with a strap 300 for quickly adjusting the lengths of relative portions of the strap 300 as a part of the sling portion. For example, in one or more embodiments, strap 300 defines a first portion 312 and a second portion or loop portion 316 having a length in the X-axis 114 that is adjustable in accordance with the relative positioning of the buckle 100.

As depicted in FIGS. 13-16, buckle 100 and strap 300 are configured in rapid adjust configuration. For example, the second end portion 308 of the strap 300 is connected to the rearward crosswise portion 124 of the buckle 100 and doubles back to form the loop portion 316 and define a loop end portion 320. The loop portion doubles back to extend through the rearward aperture 136, serpentine over the beam portion 128, and through the forward aperture 132 to the first end portion 304. For example, depicted in FIG. 16, a serpentine pathway 604 is depicted showing the pathway the strap 300 takes through the forward and rearward apertures defined by the forward and rearward crosswise portions 124, 120.

In one or more embodiments, by connecting the portion 308 of the strap 300 to the edge of the buckle 100, the strap 300 limits friction between different portions of the strap 300 during adjustment. For example, in certain embodiments the only contact between different portions of the strap 300 occurs between the second end portion 308 and the portion of the strap 300 extending through the rearward aperture 136.

However, in various embodiments, strap 300 and buckle 100 are configured to apply friction between one another when tensile pressure or force is applied between the first end portion 304 and the loop end portion 320. As such, in various embodiments, when the buckle 100 is configured with a generally taut strap 300, the buckle 100 is secured at its user selection position along the X-axis 114. As such, in operation the buckle 100 resists movement without the direct application of force on the handle 156 or gripping portions of the buckle 100.

For example, in operation, in various embodiments, the size of the loop portion 316 is adjustable by a user by grasping the buckle 100 and quickly repositioning the buckle along the X-axis 114. In certain embodiments the buckle 100 is adjustable in a single motion. Further, as described above, in various embodiments, the handle 156, and gripping portions allow it to be easily grasped with a single hand of the user, even where the user is wearing tactical gloves.

In addition, in certain embodiments, the relative size difference between the rearward aperture 136 and the forward aperture 132 of the buckle 100 applies additional friction between the strap 300 and the buckle 100 to keep the two in place. For example, in various embodiments the smaller size 152 of the rearward aperture 136 results in a steeper angle as the strap 300 transitions through the rearward aperture 136 and over the beam portion 128. As such, greater friction is applied between the buckle 100 and strap 300 to resist movement without the direct application of force on the handle 156 or gripping portions of the buckle 100.

In certain embodiments, strap 300 is a portion of a weapon sling. In such embodiments, strap 300 is easily adjustable while the strap 300 is connected to a weapon, such as a rifle, with only one hand. In addition, in various embodiments, buckle 100 and handle 156 are readily compressible in certain firing positions. For example, in various embodiments handle 156 is readily compressible when a user is in a prone or laying position and the handle and buckle 100 are compressed between a user's body and the ground or other surface. Further, in various embodiments, because of the design of the handle 156 the handle 156 is configured to compresses to a substantially flat configuration, allowing for maximum comfort to a user in the prone position without portions of the buckle 100 poking or being uncomfortably pressed into the user's body.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A rifle sling with a rapid adjust buckle, the rapid adjust buckle comprising:

a main buckle portion having a pair of side portions and a plurality of crosswise portions that extend between the pair of side portions, the pair of side portions extending in a first direction, with the plurality of crosswise portions extending in a second direction perpendicular to the first direction, the plurality of crosswise portions including a forward crosswise portion, a rearward crosswise portion, and a third crosswise portion positioned intermediate the forward and rearward crosswise portions in the first direction, the plurality of crosswise portions spaced apart from one another in the first direction to define at least a pair of buckle apertures including a forward buckle aperture defined between the forward crosswise portion and the third crosswise portion and a rearward buckle aperture defined between the third crosswise portion and the rearward crosswise portion; and a handle portion extending in the second direction between each of the pair of side portions and over the main buckle portion to define a handle aperture with the main buckle portion;

wherein the handle portion includes a pair of connecting members connected to the pair of side portions, the pair of connecting members extending upwardly to connect to the handle portion.

2. The rifle sling of claim 1, wherein the handle portion and the main buckle portion are a unitary piece composed of a polymer material.

3. The rifle sling of claim 1, further comprising:

a gripping portion for facilitating grasping the rapid adjust buckle, the gripping portion defined in the forward crosswise portion by a frictional ridge that tapers rearwardly from an apex at a forward edge of the forward crosswise portion to a rearward edge of the forward crosswise portion.

4. The rifle sling of claim 1, further comprising:

a gripping portion for facilitating grasping the rapid adjust buckle, the gripping portion defined in each of the pair of side portions by a recess that defines a high friction region at an interface of the recess with a non-recessed portion of each of the side portions.

5. The rifle sling of claim 1, wherein the jointed connection point is defined by a thickness differential between the jointed connection point and a handle thickness of the remainder of the handle portion.

6. The rifle sling of claim 1, wherein the forward buckle aperture has an aperture width is 10% to 50% larger than an aperture width of the rearward buckle aperture.

7. The rifle sling of claim 1, wherein the handle portion is flexibly biased towards an uncompressed open shape such that the handle portion is configured to compress against the main buckle portion in response to a compressing force but return to the uncompressed open shape when the compressing force is relieved.

8. The rifle sling of claim 7, wherein the pair of connecting members extend outwardly angled away from one another such that, when the handle portion is flattened, the pair of connecting members flair outwardly at a jointed connection point to reduce the vertical height of the handle portion.

9. The rifle sling of claim 8, wherein a flattened profile of the handle portion reduces a vertical height of the handle portion in the range of 30% to 90% of an uncompressed handle height.

10. The rifle sling of claim 8, wherein the handle portion includes a plurality of jointed connection points that are configured to flatten the profile of the handle portion when the handle portion is exposed to the compressing force.

11. The rifle sling of claim 8, wherein the flexibility of the handle portion is defined by a handle thickness in the range of 33% to 75% of a thickness of the main buckle portion.

12. The rifle sling of claim 8, wherein the flexibility of the handle portion is defined by a handle thickness, the handle thickness in the range of 0.25 centimeters to 0.75 centimeters.

13. A sling portion of a rifle sling, the sling portion comprising:

a rapid adjust buckle including:

a main buckle portion having a pair of side portions and a plurality of crosswise portions that extend between the pair of side portions, the pair of side portions extending in a first direction, with the plurality of crosswise portions extending in a second direction perpendicular to the first direction, the plurality of crosswise portions including a forward crosswise portion, a rearward crosswise portion, and a third crosswise portion positioned intermediate the forward and rearward crosswise portions in the first direction, the plurality of crosswise portions spaced apart from one another in the first direction to define at least a pair of buckle apertures including a forward buckle aperture defined between the forward crosswise portion and the third crosswise portion and a rearward buckle aperture defined between the third crosswise portion and the rearward crosswise portion; and a handle portion extending in the second direction between each of the pair of side portions and over the main buckle portion to define a handle aperture with the main buckle portion;

wherein the handle portion includes a pair of connecting members connected to the pair of side portions, the pair of connecting members extending upwardly to connect to the handle portion; and a strap extending from a first end portion to a second end portion, the rapid adjust buckle and the strap in rapid adjust configuration with the second end portion of the strap is connected to the rearward crosswise portion of the main buckle portion and doubled back to form a variable length loop portion and a loop end portion, the strap further extending through the rearward buckle aperture and serpentined over the third crosswise portion and through the forward buckle aperture;

wherein a length of the loop portion is adjustable by repositioning the buckle along a longitudinal axis of the sling portion.

14. The sling portion of claim 13, wherein the strap and rapid adjust buckle are configured to apply friction between one another when a tensile force is applied between the first end portion of the strap and the loop end portion.

15. The sling portion of claim 13, wherein the rapid adjust buckle further comprises:

a gripping portion for facilitating grasping the main buckle portion, the gripping portion defined in each of the pair of side portions by a recess that defines a high friction region at an interface of the recess with a non-recessed portion of each of the side portions.

16. The rifle sling of claim 13, wherein the handle portion is flexibly biased towards an uncompressed open shape such that the handle portion is configured to compress against the main buckle portion in response to a compressing force but return to the uncompressed open shape when the compressing force is relieved.

17. The rifle sling of claim 16, wherein the pair of connecting members extend outwardly angled away from one another such that, when the handle portion is flattened, the pair of connecting members flair outwardly at a jointed connection point to reduce the vertical height of the handle portion.

18. A rifle sling comprising:

a first sling portion including a strap extending from a first end portion to a second end portion, the first end portion connected to a first weapon connector for connection to a weapon system;

a second sling portion including a strap extending from a first end portion to a second end portion, the first end portion connected to a second weapon connector for connection to a weapon system, the second sling portion further including:

a rapid adjust buckle including:

a main buckle portion having a pair of side portions and a plurality of crosswise portions that extend between the pair of side portions, the pair of side portions extending in a first direction, with the plurality of crosswise portions extending in a second direction perpendicular to the first direction, the plurality of crosswise portions including a forward crosswise portion, a rearward crosswise portion, and a third crosswise portion positioned intermediate the forward and rearward crosswise portions in the first direction, the plurality of crosswise portions spaced apart from one another in the first direction to define at least a pair of buckle apertures including a forward buckle aperture defined between the forward crosswise portion and the third crosswise portion and a rearward buckle aperture defined between the third crosswise portion and the rearward crosswise portion; and a handle portion extending in the second direction between each of the pair of side portions and over the main buckle portion to define a handle aperture with the main buckle portion;

wherein the handle portion includes a pair of connecting members connected to the pair of side portions, the pair of connecting members extending upwardly to connect to the handle portion; and a sling connector connecting the first sling portion and the second sling portion together, the sling connector connected to the second end portion of the first sling portion and the loop end portion of the second sling portion.

19. The rifle sling of claim 18, wherein the first sling portion includes a padded portion having a length that makes up 50% to 80% of a total length of the first sling portion.

20. The rifle sling of claim 18, wherein the sling connector is a buckle.

21. The rifle sling of claim 18, wherein the sling connector is a third sling portion.

22. The rifle sling of claim 21, wherein the third sling portion is an elastic portion that extends from a first end to a second end, wherein the elastic portion is configured provide an elastic length adjustment in the range of approximately 4 inches.

23. The rifle sling of claim 18, wherein the sling connector includes two or more additional sling portions.

24. The rifle sling of claim 18, wherein the rifle sling is configurable between a single-point and two-point connection with a weapon system.

25. The rifle sling of claim 18, wherein the handle portion is flexibly biased towards an uncompressed open shape such that the handle portion is configured to compress against the main buckle portion in response to a compressing force but return to the uncompressed open shape when the compressing force is relieved.

26. The rifle sling of claim 25, wherein the pair of connecting members extend outwardly angled away from one another such that, when the handle portion is flattened, the pair of connecting members flair outwardly at a jointed connection point to reduce the vertical height of the handle portion.

* * * * *